United States Patent [19]

Suzuki et al.

[11] Patent Number: 4,479,995

[45] Date of Patent: Oct. 30, 1984

[54] PLASTIC CARD HAVING METALLIC LUSTER

[75] Inventors: Norimoto Suzuki; Fukuichiro Hayakawa, both of Tokyo, Japan

[73] Assignees: Dai Nippon Insatsu Kabushiki Kaisha; Taihei Kagaku Seihin Kabushiki Kaisha, both of Japan

[21] Appl. No.: 398,874

[22] Filed: Jul. 16, 1982

[30] Foreign Application Priority Data

| | | | |
|---|---|---|---|
| Jul. 21, 1981 | [JP] | Japan | 56-108214[U] |
| Dec. 26, 1981 | [JP] | Japan | 56-197149[U] |
| Dec. 26, 1981 | [JP] | Japan | 56-197150[U] |

[51] Int. Cl.[3] ..... G09F 3/02; G03C 11/08

[52] U.S. Cl. ..... 428/203; 428/900; 428/209; 40/615; 40/625

[58] Field of Search ..... 428/203, 209, 900, 461, 428/204, 207; 40/2.2, 615

[56] References Cited

U.S. PATENT DOCUMENTS

| | | | |
|---|---|---|---|
| 1,539,084 | 5/1925 | Higgins | 428/15 X |
| 1,606,030 | 11/1926 | Higgins | 428/15 X |
| 1,941,518 | 1/1934 | Twichell | 428/15 X |
| 3,581,416 | 6/1971 | Andrews | 40/2.2 X |
| 3,582,452 | 6/1971 | Britton | 428/209 |
| 3,647,603 | 3/1972 | Esemplare et al. | 428/203 |
| 4,066,873 | 1/1978 | Schatz | 40/2.2 X |
| 4,100,011 | 7/1978 | Foote | 40/2.2 X |

*Primary Examiner*—George F. Lesmes
*Assistant Examiner*—Nancy A. B. Swisher
*Attorney, Agent, or Firm*—Parkhurst & Oliff

[57] ABSTRACT

A colored plastic sheet is interposed between a pair of metallic luster plastic sheets having metallic luster pigment dispersed therein and sandwiched between a pair of transparent plastic sheets to form a metallic luster plastic card. The metallic luster plastic card has good and homogeneous luster with the use of a relatively small amount of a metallic luster pigment without entailing an increase of the total thickness of the card and also has a high optical transmission density which is required for positional recognition of the card.

10 Claims, 3 Drawing Figures

PLASTIC CARD HAVING METALLIC LUSTER

BACKGROUND OF THE INVENTION

This invention relates to a plastic card having metallic luster.

Presently, an extremely great number of plastic cards such as identification cards, bank cards, membership cards, credit cards, etc. are being utilized. These cards are used as they are, or function as magnetic cards of which various kinds of information are recorded by magnetic recording methods.

In recent years, several cards of beautiful exterior appearance having metallic luster have been proposed. A card of this type of the prior art has a structure in which a printed layer with metallic luster is formed by printing a plastic sheet, with printing ink having a metallic luster pigment dispersed therein by off-set printing or screen printing techniques, and having a transparent plastic sheet laminated on the printed layer. Another example of such a card has a structure in which a metallic luster powder layer is formed by adhesion of metallic powders with an adhesive onto a plastic sheet, and a transparent sheet is laminated on the powdery layer.

However, it is difficult to obtain sufficient metallic luster because of technological difficulty in providing a thick metal luster printed layer or metal luster powder layer. Another difficulty is that a transparent plastic sheet can be readily peeled off due to insufficient bonding between the transparent plastic sheet and the metal luster printed layer or the metal luster powder layer.

To overcome these aforementioned difficulties, an alternative structure in which a metal luster plastic sheet is prepared by dispersing a metal luster pigment into a transparent plastic by Kneading, and subsequently laminating a transparent plastic sheet onto the metal luster plastic sheet has also been proposed. However, problems still exist due to the greater particle size of metal luster pigments, as compared with the common coloration pigments, and also to very poor dispersibility of the aforementioned pigments in plastics.

More specifically, when the pigment concentration is increased to improve the metal luster, the dispersibility of the pigment decreases, whereby irregularities are liable to occur in the metal luster color formation, and the problem of the pigment adhering to a rolling roll during the preparation of the sheet causes inconvenience in production procedures. Further, the physical properties such as tensile strength and impact resistance of the sheet are lowered. Therefore, a good plastic card has not yet been produced.

Also, because of the aforementioned difficulty of obtaining a card with a high pigment concentration, the resultant card may sometimes be semi-transparent when made to the conventional thickness ranging between 0.7 and 0.8 mm. Hence, when using such a card in, for example, various card treatment devices, optical detection of the card position may not be possible because of the excessively high light transmittance of the card.

SUMMARY OF THE INVENTION

The present invention was made in view of the aforementioned background and to overcome the aforementioned drawbacks.

An object of the present invention is to provide a sufficiently strong plastic card having a metallic luster with low light transmittance therethrough.

According to the results of laboratory-type studies, an effective means for accomplishing the above objects is to use laminated metal luster layers formed by dividing a metal luster sheet, as used in the metal luster card of the prior art, into two layers and interpose a colored plastic sheet of a relatively deep color therebetween. Thus, a metal luster with a better appearance is achieved by interposing a colored plastic sheet between a pair of plastic sheets containing relatively small amounts of a metal luster pigment therein, rather than placing a higher concentration of metal luster pigment within a single plastic sheet. Therefore, the various problems associated with using a high concentration of a metal luster pigment in a single plastic sheet are no longer of concern in light of the aforementioned process.

DETAILED DESCRIPTION OF THE INVENTION

The present invention is described in detail below with respect to a preferred embodiment and modifications thereof shown in the accompanying drawings. In the following description, all quantities expressed in "parts" refer to weight.

Figure 1:
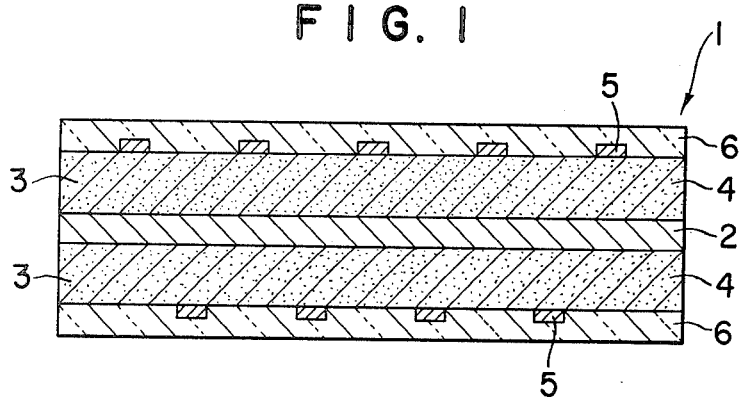
FIGS. 1, 2, and 3 are sectional views taken in planes parallel to the direction of the thickness of various embodiments of plastic cards of the present invention.

FIG. 1 shows a plastic card 1 having metal luster pigment in a pair of plastic sheets and represents a preferred embodiment of the present invention. The plastic card 1 has metal luster plastic sheets 4 containing a metal luster pigment 3 and laminated respectively on opposite surfaces of an interposed colored plastic sheet 2. Each of the metal luster plastic sheets 4 have an optional visible recording layer 5 formed on their respective external surfaces, and also have a transparent plastic sheet 6 laminated on the external surface of the metal luster plastic sheet 4 to cover the visible recording layer 5. The normal thickness of the card as a whole ranges between 0.7 to 0.8 mm.

The base resin materials constituting the colored plastic sheet 2, the metal luster plastic sheets 4 and the transparent plastic sheets 6 may be formed from similar or different materials, and can be formed from such materials as polyvinyl chloride, polyethylene, polypropylene, polyester, polystyrene, and polycarbonate. It is desirable to use a material having a good transparency.

The colored plastic sheet 2 may be prepared by kneading a coloration pigment with the aforesaid resin under heating, and then by rolling or other equivalent treatments to form a sheet having a smooth surface. To impart a good metal luster to the resultant card, the present invention requires a combination of the metal luster plastic sheets 4, with the colored plastic sheet 2, having a color which is relatively deep, and preferably having a Munsell color system lightness in the range of 0 to 3. It is desirable for the colored plastic sheet to have an optical transmission density of 1.8 or more to provide for easy discernment of the printed layer and ease in positional detection. Any coloration pigment which yields the above density, including, for example, black pigments such as carbon black, lamp black, and diamond black; gray pigments obtained by dilution of these black pigments with white pigments such as titanium white; and chromatic color pigments such as phthalocyanine blue, Watchung red, and titanium yellow are suitable for use in the plastic sheet the selected pigment is typically used in a quantity ranging between of 0.5 to 15.0 parts per 100 parts of the plastic, but a black pigment is used in a quantity ranging from 0.5 to 5 parts, a gray pigment (prepared by dilution of a black pigment with, for example, 10- to 20-fold quantity of white pigment) in a quantity ranging from 5 to 15 parts. Thus, a black pigment is the most preferable since it gives a deep colored plastic sheet by using only a small amount of pigment and can also produce a homogeneous and good metal luster because of the combination with the metallic luster sheets 4. The colored plastic sheet 2 has a thickness which may be freely selected within a specified range to give the above density, but is generally within the range of 0.1 to 0.4 mm when producing a plastic card with a thickness of about 0.7 to 0.8 mm.

The metallic luster plastic sheets can be obtained by kneading the metallic luster pigment with the above-described resin by heating and thereafter forming the resultant mixture into sheets by rolling, etc. Examples of the metallic luster pigment are; lead-based compounds such as basic lead carbonate, acidic lead arsenate; bismuth-based compounds such as bismuth oxychloride; mica-based pigments comprising mica flakes or mica flakes coated with titanium oxide; metal powders such as aluminum or brass; nonmetallic powders such as fish scales scraped from fish, such as a scabbard or hairtail, are ground into a fine powder and then formed into a paste. These metallic luster pigments generally comprise particles of greater size than the coloration pigments which produce the colored plastic sheet 2 and are therefore poorly dispersible in the resin. These metallic luster pigments are used generally in the range from 1.0 to 10 parts based on 100 parts of a resin. In the case where a plastic card 1 with a thickness of 0.7 to 0.8 mm is desired to be achieved, the metallic luster plastic sheets 4 are each of a thickness of approximately 0.1 to 0.3 mm.

The transparent plastic sheets 6 are prepared by forming the resin as described above, into sheets. A plastic card having a thickness of 0.7 to 0.8 mm, has transparent plastic sheets each having a thickness of approximately 0.1 to 0.2 mm.

In the preparation of the colored plastic sheet 2, the metallic luster plastic sheets 4 and the transparent plastic sheets 6, small amounts of stabilizers and lubricants, in addition to the resin and the pigment, are added, at specific times during the heating and kneading.

The visible recording layers 5 are formed on respective external surfaces on the metallic luster plastic sheets 4, ordinarily by off-set printing or silk screen printing, to provide patterns, figures, letters, etc., on the card.

In the preparation of the plastic card 1, the metallic luster plastic sheets 4 are placed on both surfaces of the colored plastic sheet 2. The visible recording layers 5 are formed prior to the placement of metallic luster plastic sheets 4 upon the colored plastic sheet 2. The transparent plastic sheets 6 are then placed upon the metallic luster plastic sheets 4 under appropriate pressure and temperature conditions to obtain the desired product. If necessary, it is also possible to employ an adhesive between the sheets.

Figure 2:
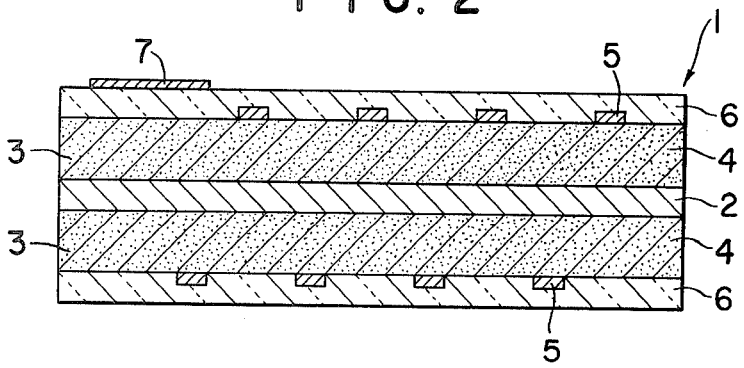
Figure 3:
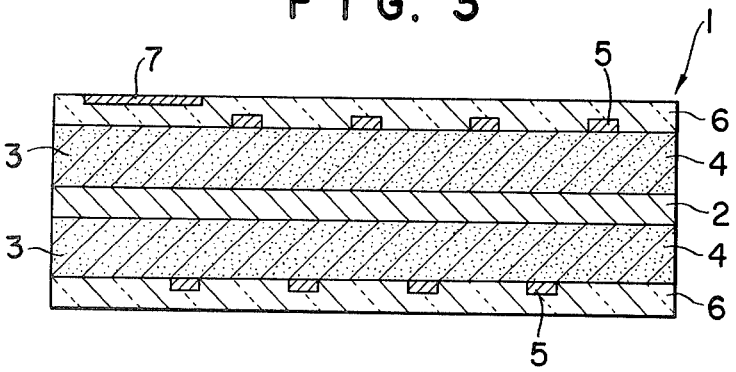

In the foregoing description, the basic embodiment of the plastic card of the present invention has been described with reference to FIG. 1. This plastic card can be utilized for identification cards, member cards, credit cards, etc. However, the most attractive use of the plastic card of the present invention is that of a magnetic card. In this instance, as shown in FIG. 2 or 3, a magnetic recording layer 7, in the shape of, for example, a stripe, comprising magnetic powder such as $\gamma$-$Fe_2O_3$ dispersed in a thermoplastic or thermosetting resin binder, is formed on (FIG. 2) or embedded in (FIG. 3) at least one of the transparent plastic sheets 1. The structure of FIG. 3 can be obtained by previously forming the magnetic recording layer 7 on one of the transparent plastic sheets 6 and then laminating the colored plastic sheet 2, along with a pair of the metallic luster plastic sheets and the other transparent plastic sheet thereon, under appropriate heating and pressing conditions.

The thus formed plastic card 1, containing a magnetic strip, maintains a relatively thin total thickness (approximately 0.7 to 0.8 mm), has a good metallic luster, due to the presence of the deep colored plastic sheet 2, and also satisfies the standard of light transmission density of 2.0 or more, according to the Japanese Industrial Standard (JIS B 9560) pertaining to credit cards equipped with magnetic stripes. In particular, when a black colored plastic sheet 2 is employed, a card with an optical transmission density of 5.0 or more can be readily obtained. Thus, detection of the position of the card by means of a card treating device can be positively carried out without any difficulty in optical reading.

As described above, the plastic card of the present invention exhibits very beautiful metallic luster even with a small content of a metallic pigment because it markedly improves the aesthetic effect of the metallic luster plastic sheet by providing the colored plastic sheet 2 between the two metallic luster plastic sheets 4. Further, the card has various other advantages such as easier preparation and lower cost.

The present invention will now be further illustrated by way of the following examples of preparing the plastic card according to the present invention.

EXAMPLE 1

After kneading 100 parts of a polyvinyl chloride, 3.0 parts of a tin-based stabilizer (dibutyl tin maleate), 2.0 parts of a lubricant and 4.0 parts of carbon black under heating, the mixture was molded into a black plastic sheet with a thickness of 0.1 mm. Separately, after kneading 100 parts of polyvinyl chloride, 3.0 parts of the tin-based stabilizer, 2.0 parts of a lubricant (stearyl alcohol) and 5.0 parts of a metallic luster pigment (a lead carbonate-based pigment, average diameter: 30–78 μm; trade name: Pearl Essence DC HG Gold produced by Nippon Kōken Kōgyō K. K.), the mixture was molded into two sheets of a metallic luster sheet with a thickness of 0.23 mm. On these sheets, there were formed visible recording layers such as patterns or figures by offset printing. Next, on both sides of the black plastic sheet, the metallic luster plastic sheets with the visible recording layers were superposed with the visible recording layers positioned as external sides. This step was followed by lamination of a transparent plastic sheets made of a transparent rigid polyvinyl chloride. Then, the composite structure was placed between mirror-finished stainless steel luster plates and heated and pressed at 150° C. under a pressure of 30 $Kg/cm^2$ for 10 minutes, whereby fusion adhesion was fully accomplished thereby producing a plastic card having a beautiful metallic luster.

The optical transmission density of the plastic card was measured by a Macbeth TD404 optical transmission densitometer (Filter: Latten #106) and found to be 5.5.

EXAMPLE 2

The procedure of example 1 was repeated except that a mixture of pigments of 1.0 part of carbon black and 10 parts of titanium white was used instead of 4.0 parts of carbon black to obtain a gray plastic sheet with a thickness of 0.1 mm in place of the black plastic sheet.

Using this gray plastic sheet, and otherwise following the procedure of Example 1, a plastic card which had a beautiful metallic luster was prepared. The plastic card was found to have an optical transmission density of 3.0.

EXAMPLE 3

The procedure of example 1 was repeated except that a mixture of pigments of 5.0 parts of phthalocyanine blue and 10 parts of titanium white was used instead of 4.0 parts of carbon black to obtain a blue plastic sheet with a thickness of 0.1 mm.

Using this blue plastic sheet instead of the black plastic sheet, and otherwise following the procedure of Example 1, a plastic card which had a beautiful metallic luster was prepared. The plastic card was found to have an optical transmission density of 2.5.

EXAMPLE 4

The procedure of Example 1 was repeated except that 9 parts of a mica-based metallic luster pigment (Trade name: "AFFLAIR" GOLD NF-144D produced by MERCA Co.) was used instead of 5 parts of the lead carbonate based pigment.

The resultant plastic card was found to have an equally beautiful metallic luster and an optical transmission density of 5.5.

What is claimed is:

1. A multilayer plastic card having metallic luster comprising:

a colored plastic sheet having a light transmission density of not less than 1.8;

metallic luster plastic sheets containing a metallic luster pigment with said metallic luster plastic sheets laminated on respective opposite surfaces of the colored plastic sheet; and transparent plastic sheets laminated on respective outer surfaces of the metallic luster plastic sheets.

2. The plastic card of claim 1, wherein the colored plastic sheet has a lightness of 0 to 3 according to the Munsell color system.

3. The plastic card of claim 1, wherein the colored plastic sheet is black.

4. The plastic card of claim 1, wherein the colored plastic sheet is gray.

5. The plastic card of claim 1, wherein the colored plastic sheet has a chromatic color.

6. The plastic card of claim 1, wherein a magnetic stripe is provided on the surface of at least one of the transparent plastic sheets.

7. The plastic card of claim 1, wherein a magnetic strips is embedded in at least one of the transparent plastic sheets so that the outer surfaces of the strip and the sheet lie in the same plane.

8. The plastic card of claim 1, wherein the outer surface of the plastic card has a visible recording layer thereon.

9. The plastic card of claim 1, whereby the multiple layers are heat and pressure fused.

10. The plastic card of claim 9, whereby the multiple layers are further fused by an adhesive between the layers.

* * * * *